US010070730B2

(12) United States Patent
Frankel et al.

(10) Patent No.: US 10,070,730 B2
(45) **Date of Patent: *Sep. 11, 2018**

(54) FOLDING CHAIR WITH SIDE BAGS ON BOTH SIDES

(71) Applicant: Zenithen USA LLC, Diamond Bar, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Upland, CA (US)

( * ) Notice: Subject to any disclaimer, the term of this patent is extended or adjusted under 35 U.S.C. 154(b) by 79 days.

This patent is subject to a terminal disclaimer.

(21) Appl. No.: 15/229,458

(22) Filed: Aug. 5, 2016

(65) Prior Publication Data

US 2018/0035811 A1 Feb. 8, 2018

(51) Int. Cl.
*A47C 4/28* (2006.01)
*A47C 7/62* (2006.01)

(52) U.S. Cl.
CPC ..... *A47C 7/62* (2013.01); *A47C 4/286* (2013.01)

(58) Field of Classification Search
CPC .. A47C 4/286; A47C 4/48; A47C 4/28; A47C 4/24; A47C 4/283
See application file for complete search history.

(56) References Cited

U.S. PATENT DOCUMENTS

| | | | | |
|---|---|---|---|---|
| 3,000,667 | A * | 9/1961 | Dryden | A01K 97/06 297/183.5 |
| 6,629,722 | B1 * | 10/2003 | Tang | A47C 7/62 297/188.08 |
| 7,604,288 | B1 * | 10/2009 | Verhulst | A45F 4/02 297/129 |
| 8,752,889 | B1 * | 6/2014 | Nievinski | F41A 23/14 297/184.11 |
| 2004/0227381 | A1 * | 11/2004 | Redzisz | A47C 4/283 297/42 |
| 2008/0012399 | A1 * | 1/2008 | Lin | A47C 4/283 297/188.08 |
| 2010/0164256 | A1 * | 7/2010 | Salisbury | A47C 4/286 297/16.2 |
| 2013/0328362 | A1 * | 12/2013 | Miller | A47C 7/62 297/188.2 |
| 2014/0252817 | A1 * | 9/2014 | Lovley, II | A47C 7/66 297/184.15 |
| 2014/0312659 | A1 * | 10/2014 | Moon | A47C 7/54 297/16.2 |

(Continued)

*Primary Examiner* — Timothy J Brindley
(74) *Attorney, Agent, or Firm* — Merek, Blackmon & Voorhees, LLC

(57) ABSTRACT

This invention is to a type of folding chair with side bags on both sides, composed of a folding stand as well as seat fabric and backrest fabric fixed to the folding stand. When the folding stand is opened, the seat fabric and the backrest fabric are in an unfolded, open state. Its characteristics are: corresponding side bags are provided at the seat fabric edges or on the handrails on both sides of the folding chair. A corresponding locking mechanism is provided at the bottom or back of the two side bags. When the folding stand is folded, the two side bags will wrap around the outer sides, forming a binding packaging structure with the interlock of the locking mechanism at the bottom or the back of the side bags.

9 Claims, 4 Drawing Sheets

(56) References Cited

U.S. PATENT DOCUMENTS

| | | | | |
|---|---|---|---|---|
| 2015/0230618 | A1* | 8/2015 | Scott | A47C 4/286<br>297/180.13 |
| 2017/0127837 | A1* | 5/2017 | Brune | A47C 4/28 |
| 2018/0027970 | A1* | 2/2018 | Frankel | A47C 4/30 |

* cited by examiner

FOLDING CHAIR WITH SIDE BAGS ON BOTH SIDES

BACKGROUND OF THE INVENTION

1. Field of the Invention

The present invention is in the field of folding furniture. Specifically, it is a type of folding chair with bags on both sides. The side bags can be used to pack up the folded folding chair while also providing space to accommodate objects when the chair is in use.

Technical Background

Existing folding chairs are widely used. They are appliances for people at leisure or engaged in outdoor activities to sit on or lie on. Currently there are two types of folding forms. One is a flat folding form in which the folding chair has a planar ("compact") structure after it is folded. This type of folding chair is generally suitable for use in gardens and other relatively stable environments. The second type is a three-dimensional folding form, which means that it folds completely. It can be folded into a bundle and is easy to carry, especially for use with outdoor activities. It has become a standard tool for outdoor sports. Three-dimensional folding chairs are equipped with side bags. These side bags can be used to pack up the folding chair when it is folded into a bundle. The side bags also restrain the folding stand so that it does not open up, making it hard to carry and store; this also greatly reduces the volume occupied by the stand. A three-dimensional folding chair is composed of a folding stand as well as seat fabric and backrest fabric that are hung on the stand. Each face of the folding stand is linked by crossing articulated diagonal bar sets. The diagonal bar points in neighboring faces are articulated by the upper corner plate and the lower corner plate and other components, forming a linked integrated structure. Once the positions of two particular intersecting diagonal bars are relatively fixed, the folding stand of a folding chair cannot be opened, which makes it convenient to pack and store the folding chair. By contrast, the traditional approach to packing up this sort of chair is to use a separate bag. For this sort of finished product, the overall condition is good, but the bag is separate from the chair and it is easily lost in the use process, causing inconvenience of re-storage and re-packing of the chair. How to solve this problem is the object of research of this utility model.

SUMMARY OF THE INVENTION

This invention was made produced with the intention of designing a type of folding chair with a side bag at corresponding positions on both sides. After the chair is folded, these side bags wrap around the outer sides of the folded chair to form a bag-shape by which the chair can be carried.

The invention is achieved as follows: the invention is to a type of folding chair with side bags on both sides, composed of a folding stand as well as a seat fabric and a backrest fabric fixed to the folding stand. When the folding stand is opened ("deployed"), the seat fabric and the backrest fabric are in an unfolded, "open" state. Its characteristics are: corresponding side bags are provided at the seat fabric edges or on the handrails on both sides of the folding chair. A corresponding locking mechanism is provided at the bottom or back of the two side bags. When the folding stand is folded, the two side bags will wrap around the outer sides, forming a binding packaging structure with the interlock of the locking mechanism at the bottom or the back of the side bags.

On the seam of the afore-mentioned side bags, a packing strap is preferably sewn. The two packing straps are also provided with a cooperating locking mechanism. The packing straps and the side bags are wound in opposite directions outside the folded folding stand. The two side bags wrap around part of the folding stand and the rest is packed and are restrained by two packing straps.

The above mentioned locking mechanism is preferably selected from one of the following structures: zippers, buckles, snap buttons, VELCRO ("hook and loop fastener"), or lacing straps.

The above mentioned side bags can be produced as pockets where objects can be placed and there will be at least one cup holder to place a cup in.

The above mentioned side bags are positioned at the point where the seat fabric is affixed to the folding stand.

This invention is ingenious with a reasonable design and is easy to operate. It uses side bags on both sides of the folding chair that can be produced as pockets or cup holders. When the folding chair is opened for use, the bags provide the convenience of holding objects or cups. When the chair is folded, the side bags can act as packaging straps that wrap around the outside of the folding stand to form a binding package/restraint. This dual function not only simplifies packaging, but also has a strong integrity, thereby eliminating the problem of needing to look around for a packing bag.

These and other objects of the present invention will be readily apparent upon review of the following detailed description of the invention and the accompanying drawings. These objects of the present invention are not exhaustive and are not to be construed as limiting the scope of the claimed invention. Further, it must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

BRIEF DESCRIPTION OF THE DRAWINGS

The utility model is further described below with specific illustrations.

Figure 1:
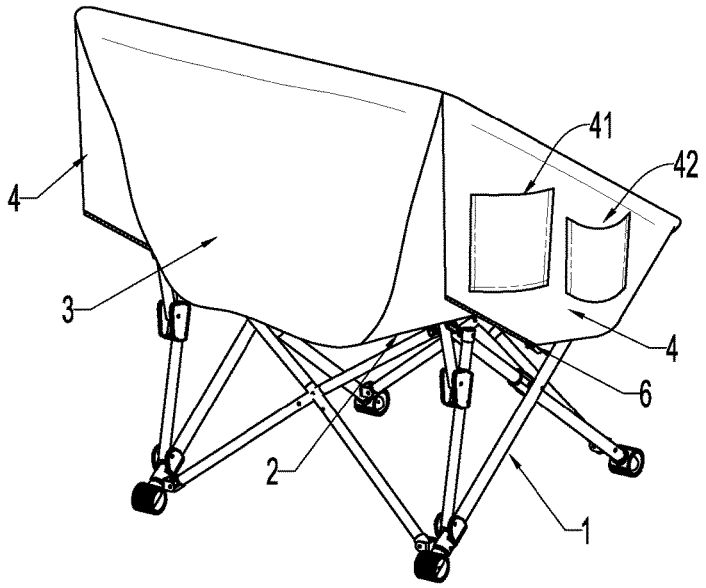
FIG. 1 is a perspective schematic of the folding chair according to a first embodiment.
Figure 2:
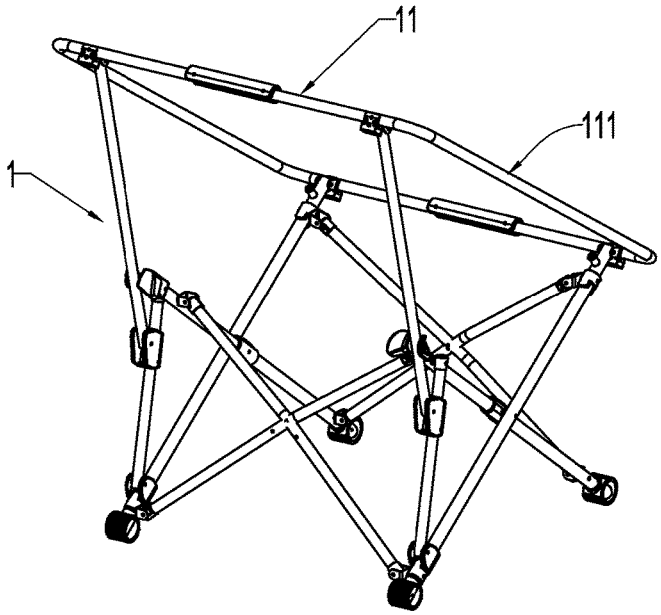
FIG. 2 is a perspective schematic of the frame of the folding stand fabric removed.
Figure 3:
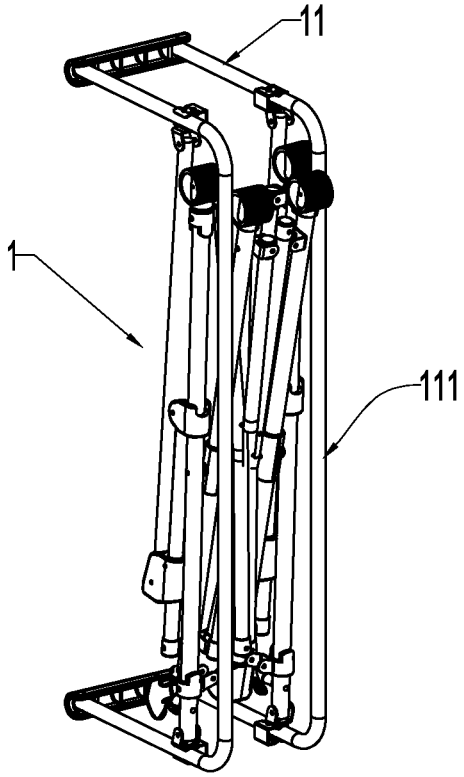
FIG. 3 is a schematic of the frame of the folding stand in its folded state.

In the drawings, the following reference numerals are described:

1—folding stand
11—support frame
111—handrail
2—seat fabric
3—backrest fabric
4—side bag

41—pocket
42—cup holder
43—hand strap
5—packing strap
6—zipper
7—snap button Similar reference characters denote corresponding features consistently throughout the attached drawings.

DETAILED DESCRIPTION OF THE PREFERRED EMBODIMENT(S)

Referring now to FIG. 1 through 5, it can be seen that the folding chair with side bags on both sides is composed of a folding stand 1 as well as seat fabric 2 and backrest fabric 3 fixed onto the folding stand. When the folding stand 1 is opened, the seat fabric 2 and the backrest fabric 3 will be in the open state. In this sample chair, there is a foldable support frame 11 above the folding stand 1. This support frame 11 spreads to open the conjoined seat fabric 2 and backrest fabric 3. In other words, the conjoined backrest fabric 3 and seat fabric 2 are hung on the support frame 11 to form the folding chair on which a person can sit. Furthermore, the two sides of the support frame 11 perform the function of handrails ("seat rests") 111 to support the user's arms. The two handrails 111 are preferably equipped with corresponding side bags 4 symmetrically. The side bags also provide more pockets to hold objects. Side bag 4 can be produced as a pocket 41 and preferably has at least one cup holder 42 to hold a water cup or bottle. The best option is to have one side bag produced as a pocket 41 and the other side bag produced as a cup holder 42. In this way, there is space to place electronics such as cell phones, pads or books and there is also have space for cups or bottles to fully meet users' outdoor recreational needs.

At the bottom or the back of side bag 4, there is a cooperative locking mechanism. In this sample, the locking mechanism is a zipper 6. When the folding stand 1 is folded, the two side bags 4 will wrap around the outside from both sides in opposite directions, with the lock of zipper 6 at the bottom or back of both side bags 4 forming a binding package structure.

In this illustrative sample, the size of the folded folding stand is relatively large. The length of the two side bags 4 is not only deep enough to hold objects, but the side bags are also long enough that they can wrap around the folding stand 1 in opposite directions and meet each other at the bottom. Therefore, the locking mechanism can be placed directly at the bottom of the two side bags 4. If the size of the folded folding stand is small and the length of the side bags 4 is large, the corresponding locking mechanism should be placed at a corresponding position on the back of the side bags 4. When packing up the chair, side bags 4 will wrap around the outside. Any extra part of the side bags can be folded inside, without affecting the packed appearance. Besides, if we moderately enlarge the width of the side bags 4, they can wrap around the majority of the folding chair to protect the seat fabric 2 and backrest fabric 3 from dust and stains. In this sample, a hand strap 43 is sewn to the back of the side bags 4 for convenience of carrying the chair after it is folded.

Figure 4:
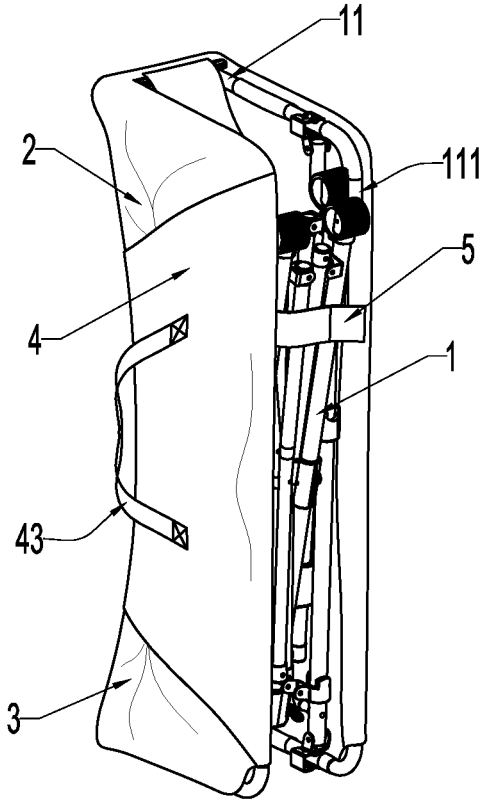
FIG. 4 is a schematic of the folding chair from the back in its folded and packed state.
Figure 5:
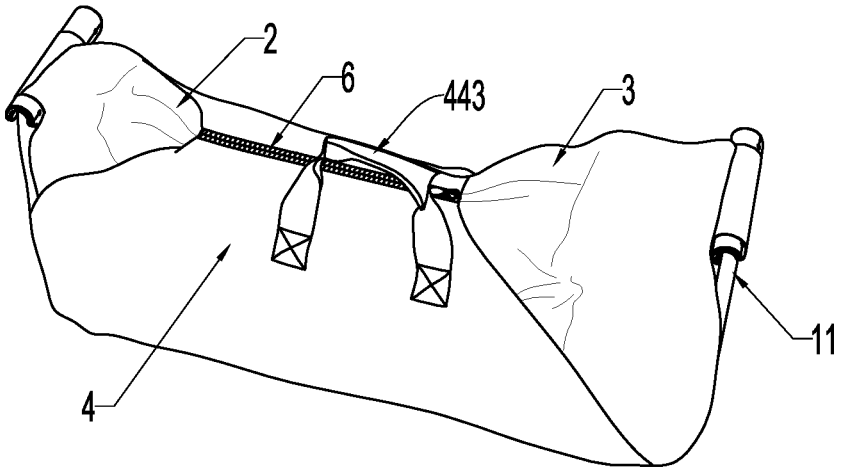
FIG. 5 is a schematic of the folding chair from the front in its folded and packed state

Moreover, the side bags 4 are preferably hung from the handrails 111. They are load-bearing; when packed, their edge is level and smooth. A packing strap 5 is sewn between the side bags 4 and the seams. The packing strap 5 is preferably made of broadside webbing. Both packing straps 5 are also provided with a cooperating locking mechanism. When the chair is folded and packed, packing straps 5 and side bags 4 wrap around the outside of the folded folding stand in opposite directions. The two side bags 4 wrap around part of the folded folding stand and the rest of the stand will be wrapped and restrained in place by the two packing straps 5 to form a completely packaged entirety, as shown in FIG. 4. The corresponding side bags 4 wrap around the front of the folding chair in opposite directions and form a protection for both the seat fabric 2 and the backrest fabric 3 and also provide hand straps 43, as shown in FIG. 5, while the two packing straps 5 wrap around the back of the folding chair in opposite directions and act as restraints holding the folding stand 1 in place, especially the foot section of the stand. They serve to pack the folding chair into one whole unit.

In this sample, the specific structure of the locking mechanism used is zipper 6. The locking mechanism can also be chosen from buckles, snap buttons ("snaps"), VELCRO, or lacing straps ("laces"). If we use VELCRO or buckles at the end of the above mentioned packing straps 5, the operation will be the easiest. Of course one could also directly knot the ends of both packing straps.

In this sample, side bags 4 and packing straps 5 are placed at the handrails 111, such that they are sewn to the handrail fabric. This can be applied to any folding chair with handrails to form an integrated folding chair with self-contained packing device. The best option is to have a pair of side bags 4 and one or two pairs of packing straps 5.

Figure 6:
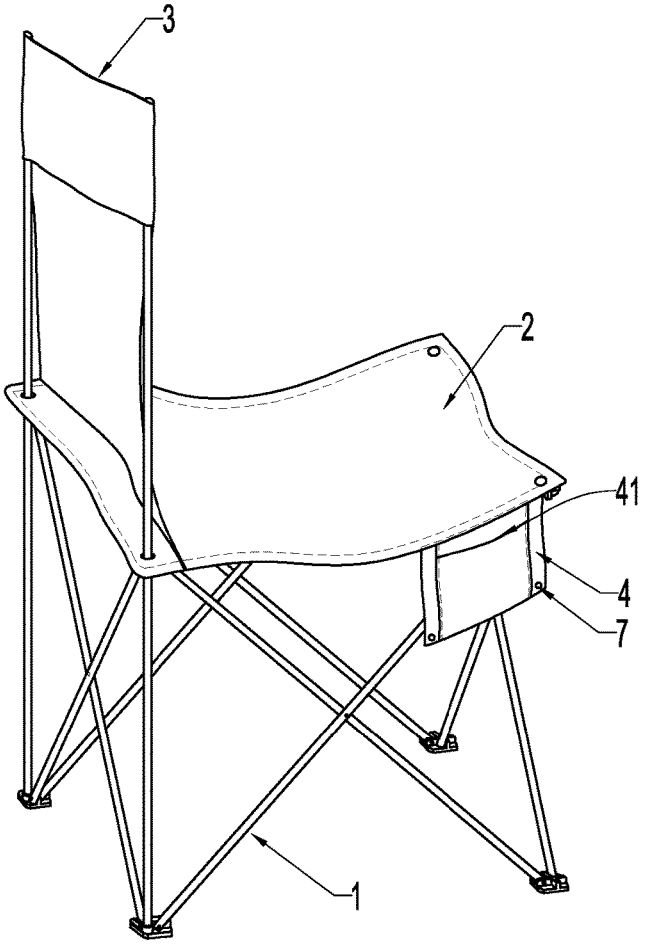
FIG. 6 is a perspective schematic of a Folding Chair according to a second embodiment.
Figure 7:
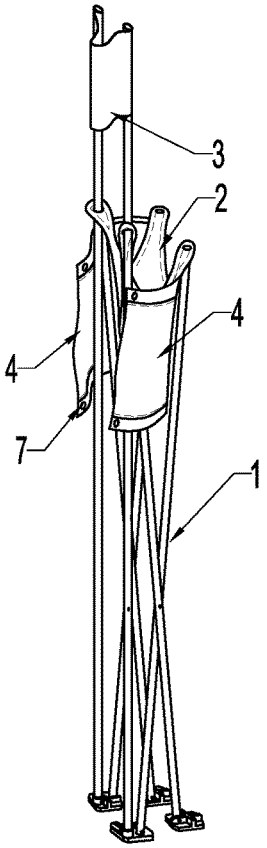
FIG. 7 is a schematic of the folding chair of FIG. 6 in its folded state.

Referring to FIGS. 6 and 7, it can be seen that this is a sample folding chair without handrails. Side bags 4 are directly placed at the edge of the seat fabric 2 and hung on both sides. Since the seat fabric 2 will be folded for storage when this type of folding chairs is folded, the width of the side bags 4 should be no larger than half the depth to which the seat fabric 2 hangs when it is folded. The side bags can be placed at the front or rear of the seat. The best option is to have side bags 4 placed at the point where seat fabric 2 is affixed to folding stand 1, that is to say, side bags 4 are close to the support point. In this sample, the locking mechanism used is a snap or button 7 which also serves as a packing lock for portable folding chairs.

In this sample, the seat fabric 2 is in a suspension structure with the points at the four corners of the stand. This can be applied to folding chairs whose seat fabric is affixed to support bars on both sides. In this case, side bags 4 are sewn to the edge of seat fabric 2 on both sides and the edge of both sides of seat fabric 2 is provided with a cloth cover. The cloth cover covers the outside of the support bars to form support for the seat fabric.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims. It is therefore to be understood that the present invention is not limited to the sole embodiment described above, but encompasses any and all embodiments within the scope of the following claims.

We claim:

1. A folding chair with side bags on both sides, comprising:

a folding stand and a seat fabric and a backrest fabric affixed to the folding stand;

when the folding stand is open, the seat fabric and the backrest fabric are in a first unfolded open state;

a plurality of side bags are provided at the seat fabric edges or on the handrails on both sides of the folding chair;

a corresponding locking mechanism is provided at the bottom or back of the two side bags;

when the folding stand is folded, the two side bags surround the outer sides of the folding chair and attach to each other by the corresponding locking mechanism to retain the chair in the second, folded state.

2. The folding chair of claim 1, further including at least one packing strap sewn to the seams of the side bags for securing around the folding chair.

3. The folding chair of claim 1, wherein the side bags are produced as pockets that store objects and further including at least one cup holder.

4. The folding chair of claim 1, wherein the side bags are placed at the point at which the seat fabric is affixed to the folding stand.

5. The folding chair of claim 2, wherein the side bags are placed at the point at which the seat fabric is affixed to the folding stand.

6. The folding chair of claim 3, wherein the side bags are placed at the point at which the seat fabric is affixed to the folding stand.

7. A folding chair with side bags on both sides, comprising:

a folding stand and a seat fabric and a backrest fabric affixed to the folding stand;

wherein when the folding stand is open, the seat fabric and the backrest fabric are in a first, unfolded open state;

two side bags are provided at the seat fabric edges or on handrails on both sides of the folding chair;

each of the two side bags includes at least one packing strap attached respectively to a one of the two side bags for attaching the two side bags together in the second, folded state;

each of the two packing straps includes a cooperating portion of a locking mechanism for securing the two packing straps together around the folding chair;

whereby when the folding stand is folded, the two side bags surround the outer sides of the folding chair and attach to each other by the locking mechanism to retain the chair in the second, folded state.

8. The folding chair of claim 7, further including at least two packing strap sewn to the seams of the side bags for securing around the folding chair;

the two packing straps are provided with a cooperating locking mechanism of securing the two packing straps together around the folding chair.

9. The folding chair of claim 8, wherein the locking mechanism is selected from the group of a zipper, a buckle, a snap, a button, a hook and loop fastener, or a lace.

* * * * *